US006261188B1

(12) United States Patent
Badura

(10) Patent No.: US 6,261,188 B1
(45) Date of Patent: Jul. 17, 2001

(54) EXPANDABLE BATON WITH HANDLE GRIP CAP

(76) Inventor: Mark Badura, 2430 Greenridge Dr., Medford, OR (US) 97504

( * ) Notice: Subject to any disclaimer, the term of this patent is extended or adjusted under 35 U.S.C. 154(b) by 0 days.

(21) Appl. No.: 09/489,877

(22) Filed: Jan. 20, 2000

(51) Int. Cl.[7] ..... F41B 15/02; A63B 59/06

(52) U.S. Cl. ..... 473/47.2; 473/206; 473/568; 473/47.7

(58) Field of Search ..... 463/47.2, 47.7; 473/300, 302, 303, 201, 203, 204, 206, 524, 549, 551, 552, 553, 564, 565, 568

(56) References Cited

U.S. PATENT DOCUMENTS 3,203,697 * 8/1965 Berzatzy .
4,376,536 * 3/1983 Martin .
5,257,782 * 11/1993 Schicketanz .
5,372,363 12/1994 Siddle .
5,728,003 * 3/1998 Hustad .
5,797,797 8/1998 Parsons .
6,059,675 * 5/2000 Finn .
6,135,888 * 10/2000 Hindi .
6,152,831 * 11/2000 Arcenas .

* cited by examiner

*Primary Examiner*—William M. Pierce
(74) *Attorney, Agent, or Firm*—Robert E. Howard

(57) ABSTRACT

An expandable baton having a grip cap attached to the outer end of the handle. The grip cap has a cylindrical head adapted to mate with and attach to the cylindrical outer end of the baton handle. A stop member extends outwardly from one side of the cylindrical head of the grip cap and an arm extends upwardly from the outer end of the stop member. The handle, stop member, and arm form a U-shaped finger receptacle adapted to receive a finger of the baton user to thereby provide a firm grip.

7 Claims, 1 Drawing Sheet

EXPANDABLE BATON WITH HANDLE GRIP CAP

BACKGROUND OF THE INVENTION

This invention relates to an expandable baton having a handle grip cap.

Expandable or telescoping batons are often carried by law enforcement officers today instead of the old-style night stick. Such batons are popular because they are lightweight and quite short in their collapsed configuration (about 8–10 inches. Such batons are constructed in tubular sections (typically three) with the main tubular section being the handle and with progressively smaller diameter tubular sections that fit within each other and within the handle. When expanded such batons can have a length of about one yard.

Expandable batons of the type in current use are described in U.S. Pat. Nos. 5,372,363 and 5,797,797. These batons have a removable threaded end cap screwed onto the threaded outer end of the handle section, the diameter of the end cap being substantially the same diameter as the diameter of the handle section.

In use the law enforcement officer grasps the handle of the expanded baton in his hand and swings it like a club. The forces generated by such swinging action can cause the officer to lose their grip on the baton and the baton to fly out of their hand. If this occurs during practice sessions, other participants can be injured by the flying baton. If this occurs during an altercation, the officer may be forced to go to the next level of force, i.e., draw his gun.

SUMMARY OF THE INVENTION

It is an object of this invention to provide an expandable baton with a handle grip means which minimizes or eliminates the risk of it slipping out of a law enforcement officer's hand during use.

It is a further object of this invention to provide a simple and inexpensive handle grip means which can be used in conjunction with several popular existing baton designs.

These and other objects are achieved by use of a grip cap attached to the outer end of the handle of an expandable baton.

The grip device of the present invention is configured to replace the removable end cap of several commonly used expandable baton designs.

The handle grip device of the present invention has a cylindrical head member that is adapted to mate with the outer end of the handle of an expandable baton. A finger grip member extends from one side of the cylindrical head member in a manner adapted to engage a finger, typically the small finger, of the hand of a law enforcement officer holding the baton, to thereby provide a finger stop.

DESCRIPTION OF PREFERRED EMBODIMENTS

Figure 1:
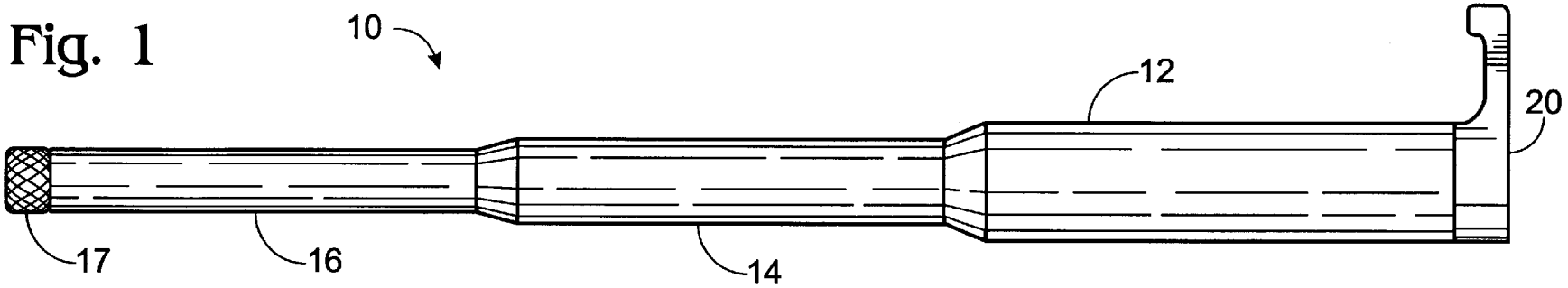
FIG. 1 is a longitudinal side view of the expandable baton with the attached handle grip cap of the invention.
Figure 2:
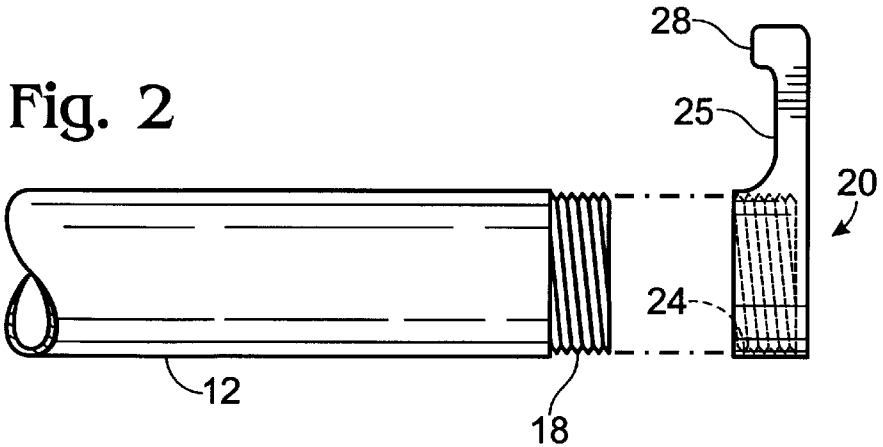
FIG. 2 is a partial, exploded and enlarged view of the handle end of the baton and the handle grip member (shown in cross-section)
Figure 3:
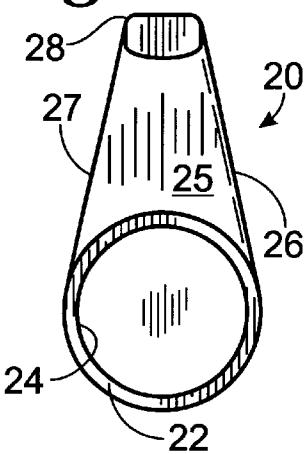
FIG. 3 is an enlarged view of the inner side of the handle grip cap.
Figure 4:
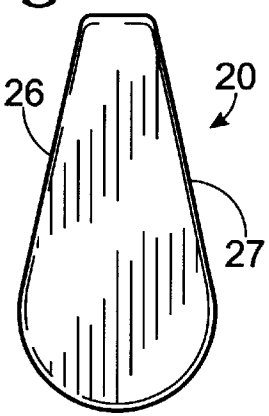
FIG. 4 is an enlarged view of the outer side of the handle grip cap.

The expandable baton 10 of the invention is shown in its extended configuration in FIG. 1.

Baton 10 is comprised of a cylindrical handle member 12, a cylindrical middle member 14, and a cylindrical end member 16 having a tip 17 located on the outer end thereof.

Cylindrical end member 16 is adapted to be retractable into cylindrical middle member 14, and cylindrical middle member 14 is adapted to be retractable into cylindrical handle member 12. The expansion and contraction mechanism of the expandable baton forms no part of the present invention as such mechanisms are well known in the baton art and as exemplified by the two patents cited above.

Cylindrical handle 12 has male threads 18 formed externally on the outer end thereof.

Handle grip cap 20 is comprised of a hollow cylindrical head member 22 having internal female threads 24 adapted to engage the external threads 18 located on the outer end of cylindrical handle 12 so that grip cap 20 can be screwed thereon, as shown in FIG. 1. The diameter of the cylindrical head of grip cap 20 is substantially identical to the diameter of cylindrical handle member 12, as shown.

Although the preferred embodiment of the invention is described as having male threads on the handle 12 and female threads within the hollow cylindrical head member 22 of the grip cap 20, these can be reversed so that the handle has female threads and the grip cap male threads. Non-threadable means may also be used to attach the grip cap 20 to the end of handle 12.

A stop member 25 extends outwardly from cylindrical head member 22 of grip cap 20 in a manner such that its major plane is substantially perpendicular to the longitudinal axis of cylindrical head member 22 and, therefore, substantially perpendicular to the longitudinal axis of cylindrical handle 12 and baton 10.

The side edges 26 and 27 at the first end of stop member 25 start on opposite sides of cylindrical member 22, i.e., 180 degrees apart, and converge towards each other as they approach the second end of stop member 25, as shown, terminating at an arm member 28. Thus, stop member 25 extends from only one side of cylindrical head member 22. Although shown as encompassing exactly one-half the circumference of cylindrical head member 22, edges 26 and 27 of stop member 25 could extend from locations on the outer circumference of cylindrical head member 22 that encompasses less than one-half the circumference thereof.

Arm member 28 projects outwardly from the outer end of stop member 25 and faces toward tip 17. The major plane of arm member 28 is substantially perpendicular to the major plane of stop member 26, and is substantially parallel to a tangent line drawn through the nearest adjacent point on the circumference of cylindrical member 22. The height of arm member 28 above the adjacent inner surface of stop member 26 is approximately the same height or less than the height of cylindrical head member 22 above the adjacent inner surface of stop member 26.

The juncture of arm member 28 with the adjacent surface of stop member 26 is rounded and smooth, as shown. Similarly, the juncture of cylindrical member 22 with stop member 26 is rounded and smooth, as shown.

Cylindrical head member 22, stop member 25, and arm 28 form a U-shaped finger receptacle. The distance between the adjacent outer surface of cylindrical member 22 and arm member 28 is selected to accommodate placement of an adult user's finger (approximately one inch) so that when baton 10 is gripped by its cylindrical handle 12 at the outer end thereof, the user's little finger rests against stop member 26 and is located between cylindrical handle 12, as extended by cylindrical member 22, and arm member 28. When so gripped, baton 10 is secured against slipping out of the hand of the user.

Grip cap 20 is preferably made of cast and machined metal. However, it could be made of an injection molded plastic or a plastic/fiber composite material.

The invention claimed is:

1. In an expandable baton having a tip located at one end thereof and a tubular handle having a threaded outer end located at the other end thereof, the improvement comprising:

a grip cap including a cylindrical head member, a stop member and an arm member;

said cylindrical head member having a longitudinal axis, an outer diameter and a height, said cylindrical head member being threadably attached to the outer end of said tubular handle member;

said stop member extending outwardly from one side of said cylindrical head member in a direction that is substantially perpendicular to the longitudinal axis of said cylindrical head member, said stop member terminating at its outer end;

said arm member projecting substantially perpendicularly outward from said outer end of said stop member toward said tip of said expandable baton a distance which is no greater than the height of said cylindrical head member;

said cylindrical head member, stop member and arm member forming a U-shaped finger receptacle adapted and configured to engage solely a single finger of a user.

2. The baton of claim 1 wherein said cylindrical head member and said tubular handle member have outer diameters that are substantially identical.

3. The baton of claim 1 wherein the outer end of said tubular handle member is threaded with male threads and said cylindrical head member is hollow and internally threaded with female threads.

4. The baton of claim 1 wherein said stop member extends outwardly from said cylindrical head member a distance of about one inch.

5. A grip cap adapted to be attached to the outer end of the handle of an expandable baton comprising:

a cylindrical head member, a stop member and an arm member;

said cylindrical head member having a longitudinal axis, an outer diameter, and a height;

said stop member extending outwardly from one side of said cylindrical head member in a direction that is substantially perpendicular to the longitudinal axis of said cylindrical head member, said stop member terminating at its outer end;

said arm member projecting substantially perpendicularly outward from said outer end of said stop member a distance which is no greater than the height of said cylindrical head member;

said cylindrical head member, stop member and arm member forming a U-shaped finger receptacle adapted and configured to engage solely a single finger of a user.

6. The baton of claim 5 wherein said cylindrical head member is hollow and internally threaded with female threads.

7. The baton of claim 5 wherein said stop member extends outwardly from said cylindrical head member a distance of about one inch.

* * * * *